US011402083B1

(12) United States Patent
Lu et al.

(10) Patent No.: US 11,402,083 B1
(45) Date of Patent: Aug. 2, 2022

(54) SPLICED LAMP TUBE

(71) Applicant: Xiamen PVTECH Co., Ltd., Fujian (CN)

(72) Inventors: Fuxing Lu, Fujian (CN); Xiaoping Lan, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/405,047

(22) Filed: Aug. 18, 2021

(51) Int. Cl.

| | |
|---|---|
| ***F21V 21/005*** | (2006.01) |
| ***F21V 23/00*** | (2015.01) |
| ***F21K 9/278*** | (2016.01) |
| ***F21S 2/00*** | (2016.01) |
| ***F21K 9/272*** | (2016.01) |
| ***F21Y 103/10*** | (2016.01) |
| ***F21Y 115/10*** | (2016.01) |

(52) U.S. Cl.
CPC ..... *F21V 21/005* (2013.01); *F21K 9/272* (2016.08); *F21K 9/278* (2016.08); *F21S 2/005* (2013.01); *F21V 23/006* (2013.01); *F21Y 2103/10* (2016.08); *F21Y 2115/10* (2016.08)

(58) Field of Classification Search
CPC ..... F21V 21/005; F21K 9/272; F21K 9/278; F21S 2/005
See application file for complete search history.

(56) References Cited

U.S. PATENT DOCUMENTS

| | | | | |
|---|---|---|---|---|
| 7,331,687 | B1 * | 2/2008 | Noh | F21S 4/20 362/217.05 |
| 2014/0071668 | A1 * | 3/2014 | Ai | F21K 9/272 362/217.17 |
| 2017/0276332 | A1 * | 9/2017 | Pearson | F21V 21/005 |
| 2017/0292664 | A1 * | 10/2017 | Pearson | F21V 29/508 |
| 2019/0346091 | A1 * | 11/2019 | Zhang | F21S 2/005 |

* cited by examiner

*Primary Examiner* — William N Harris
(74) *Attorney, Agent, or Firm* — Winston Hsu

(57) ABSTRACT

A spliced lamp tube is provided, which includes a first lamp tube assembly, a first adaptor assembly, a second lamp tube assembly and a second adaptor assembly. The first lamp tube assembly includes a first lamp head and a first light source board, and one end of the first light source board is connected to the first lamp head. The second lamp tube assembly includes a second lamp head and a second light source board, and one end of the second light source board is connected to the second lamp head. The first lamp tube assembly is connected to the first adaptor assembly and the second lamp tube assembly is connected to the second adaptor assembly. The first adaptor assembly and the second adaptor assembly can be spliced together in order to combine the first lamp tube assembly with the second lamp tube assembly.

9 Claims, 7 Drawing Sheets

SPLICED LAMP TUBE

BACKGROUND OF THE INVENTION

1. Field of the Invention

The present invention relates to a lamp tube, in particular to a spliced lamp tube.

2. Description of the Prior Art

Since the technology of light-emitting diodes (LED) has been continuously improved, lamp tubes adopting LEDs have been widely applied to various applications. Compared with conventional lamp tubes, lamp tubes adopting LEDs have many advantages which conventional lamp tubes lack, such as energy-saving, environmentally-friendly, high efficiency, long service life and small size.

However, some buildings need to use long lamp tubes (2.4 m or more), but it is hard to transport and store long lamp tubes due to the long lengths of long lamp tubes, which significantly increases the transportation and storage costs thereof.

SUMMARY OF THE INVENTION

One embodiment of the present invention provides a spliced lamp tube, which includes a first lamp tube assembly, a second lamp tube assembly, a first adaptor assembly and a second adaptor assembly. The first lamp tube assembly includes a first lamp head and a first light source board. One end of the first light source board is connected to the first lamp head. The first adaptor assembly includes a first connection element, a first adaptor board and a plurality of metal pins. The first adaptor board is disposed at one end of the first connection element and connected to the other end of the first light source board. The metal pins penetrate through the first adaptor board and protrude from the other end of the first connection element. The second lamp tube assembly includes a second lamp head and a second light source board. One end of the second light source board is connected to the second lamp head. The second adaptor assembly includes a second connection element, a second adaptor board and a plurality of metal sleeves. The second adaptor board is disposed at one end of the second connection element and connected to the other end of the second light source board. The metal sleeves penetrate through the second adaptor board and the second connection element.

In one embodiment of the present invention, the first lamp tube assembly further includes a first tube body and the first light source board is disposed in the first tube body.

In one embodiment of the present invention, the second lamp tube assembly further includes a second tube body and the second light source board is disposed in the second tube body.

In one embodiment of the present invention, the first lamp head includes a first driving circuit and the second lamp head includes a second driving circuit.

In one embodiment of the present invention, the first adaptor assembly is a male connector and the second adaptor assembly is a female connector.

In one embodiment of the present invention, the first adaptor board has a first groove and the first light source board has a bending portion corresponding to the first groove, and the bending portion is inserted into the first groove, whereby the first light source board is connected to the first adaptor board.

In one embodiment of the present invention, the second adaptor board has a second groove and the second light source board has a bending portion corresponding to the second groove, and the bending portion is inserted into the second groove, whereby the second light source board is connected to the second light source board.

In one embodiment of the present invention, the metal pins and the metal sleeves are corresponding to at least a live wire, an earth wire and a neutral wire.

In one embodiment of the present invention, the metal pins and the metal sleeves are further corresponding to a dimming circuitry and a power adjustment circuitry.

In one embodiment of the present invention, the first light source board and the second light source board are circuit boards having a plurality of light-emitting elements disposed thereon.

As described above, the spliced lamp tube in accordance with the embodiments of the present invention may have the following advantages:

(1) In one embodiment of the present invention, the first lamp tube assembly and the second lamp tube assembly can be electrically connected to each other and fixed with each other via the first adaptor assembly and the second adaptor assembly. Thus, the first lamp tube assembly and the second lamp tube assembly can be spliced together to form a complete lamp tube, which facilitates the transportation and storage of the spliced lamp tube in order to dramatically reduce the transportation and storage costs thereof.

(2) In one embodiment of the present invention, the spliced lamp tube can be directly installed on the lamp holders so as to respectively connect the first lamp head of the first lamp tube assembly and the second lamp head of the second lamp tube assembly to the neutral wire and the live wire of the lamp holders. Since the metal pins of the first adaptor assembly of the spliced lamp tube can inserted into the metal sleeves of the second adaptor assembly thereof, so the metal pins and the metal sleeves can be electrically connected to each other and corresponding to the live wire, the earth wire and the neutral wire. Accordingly, the spliced lamp tube can operate normally after being installed on the lamp holders.

(3) In one embodiment of the present invention, the spliced lamp tube has a special mechanical connection structure, which can make the first lamp tube assembly and the second lamp tube assembly be electrically connected to each other. Besides, the first lamp tube assembly and the second lamp tube assembly can be more stably fixed with each other and cannot be easily detached from each other. Therefore, the spliced lamp tube can achieve high practicality.

(4) In one embodiment of the present invention, the metal pins of the first adaptor assembly and the metal sleeves of the second adaptor assembly of the spliced lamp tube can be corresponding to a dimming circuitry and a power adjustment circuitry. Thus, the spliced lamp tube can provide dimming function and power adjustment function, so can be more comprehensively in application.

Further scope of applicability of the present application will become more apparent from the detailed description given hereinafter. However, it should be understood that the detailed description and specific examples, while indicating exemplary embodiments of the invention, are given by way of illustration only, since various changes and modifications within the spirit and scope of the invention will become apparent to those skilled in the art from this detailed description.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will become more fully understood from the detailed description given herein below and the accompanying drawings which are given by way of illustration only, and thus are not limitative of the present invention and wherein.

DETAILED DESCRIPTION

Figure 1:
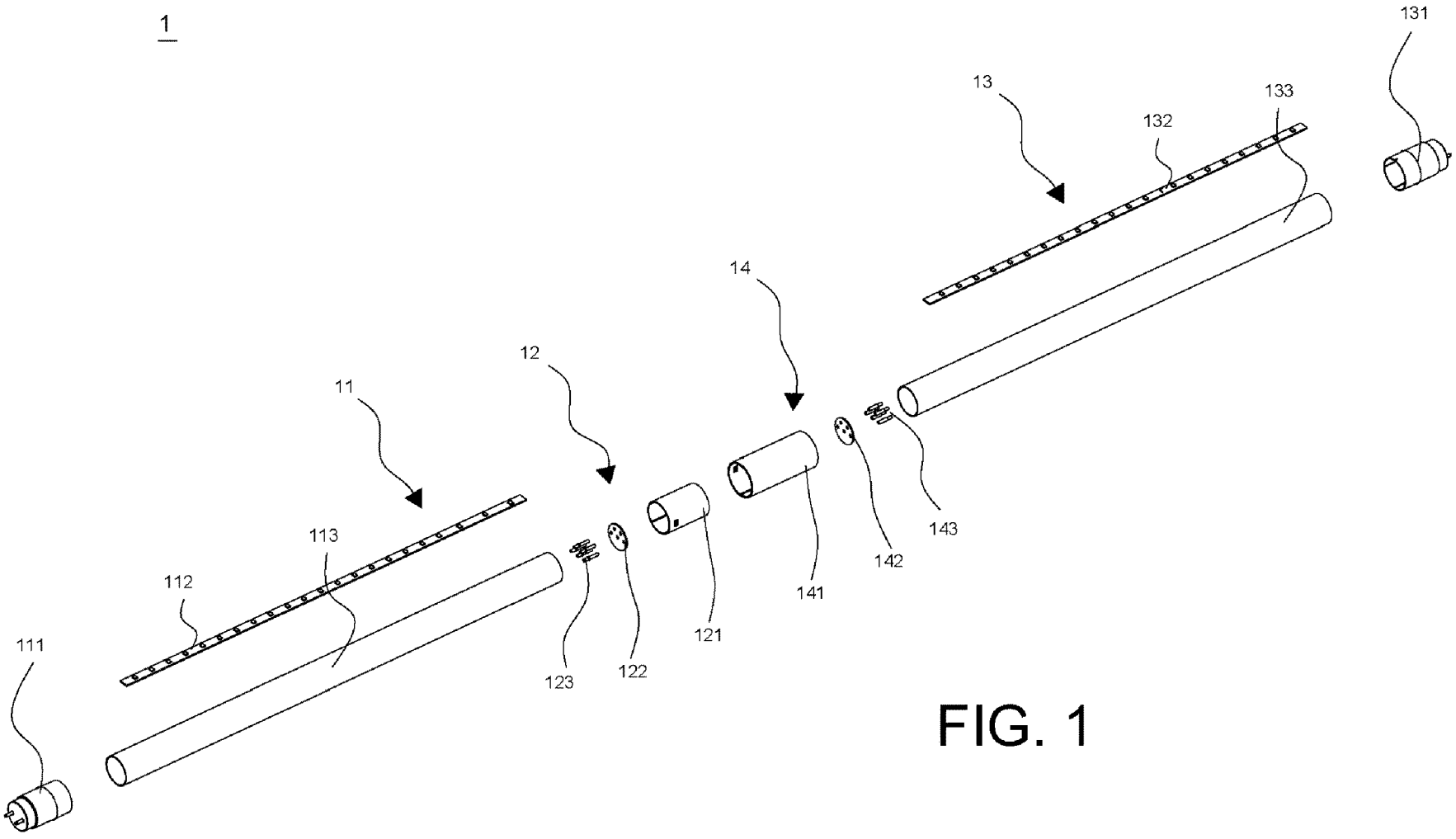
FIG. 1 is an exploded view of a spliced lamp tube in accordance with one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. It should be understood that, when it is described that an element is "coupled" or "connected" to another element, the element may be "directly coupled" or "directly connected" to the other element or "coupled" or "connected" to the other element through a third element. In contrast, it should be understood that, when it is described that an element is "directly coupled" or "directly connected" to another element, there are no intervening elements.

Figure 2:
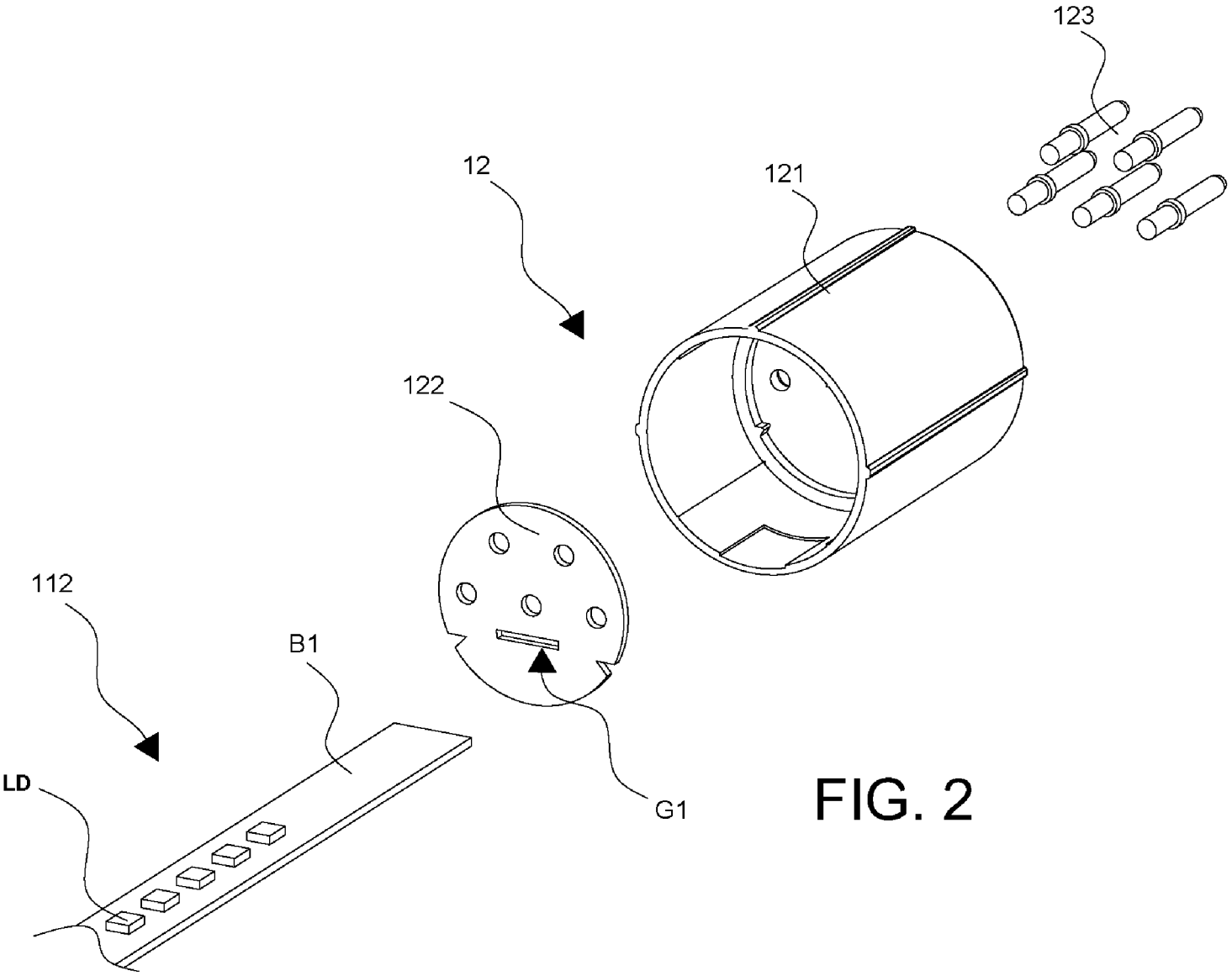
FIG. 2 is a view for illustrating a structure of a first adaptor assembly of the spliced lamp tube in accordance with one embodiment of the present invention.
Figure 3:
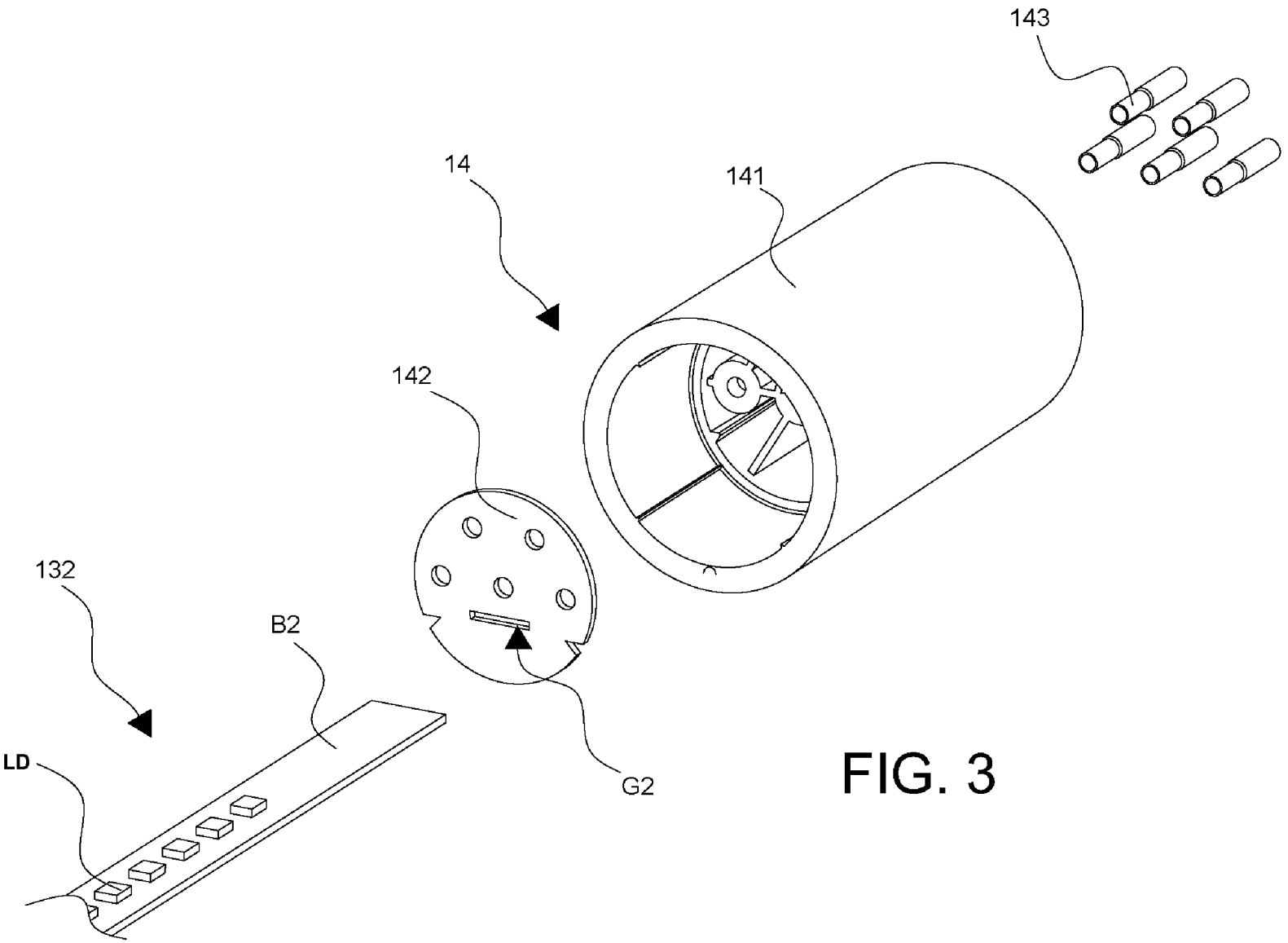
FIG. 3 is a view for illustrating a structure of a second adaptor assembly of the spliced lamp tube in accordance with one embodiment of the present invention.

Please refer to FIG. 1, FIG. 2 and FIG. 3. FIG. 1 is an exploded view of a spliced lamp tube in accordance with one embodiment of the present invention. FIG. 2 is a view for illustrating a structure of a first adaptor assembly of the spliced lamp tube in accordance with one embodiment of the present invention. FIG. 3 is a view for illustrating a structure of a second adaptor assembly of the spliced lamp tube in accordance with one embodiment of the present invention. As shown in these figures, the spliced lamp tube 1 includes a first lamp tube assembly 11, a first adaptor assembly 12, a second lamp tube assembly 13 and a second adaptor assembly 14.

The first lamp tube assembly 11 includes a first lamp head 111, a first light source board 112 and a first tube body 113. The first light source board 112 is disposed in the first tube body 113 and one end of the first light source board 112 is connected to the first lamp head 111. The first light source board 112 maybe a circuit board having a plurality of light-emitting elements disposed thereon. In this embodiment, the first light source 112 includes a first circuit board B1 and a plurality of light-emitting diodes LD disposed on the first circuit board B1. In one embodiment, the first circuit board B1 maybe a flexible printed circuit board or other similar components. In addition, the first lamp head 111 may have a first driving circuit disposed therein.

The first adaptor assembly 12 includes a first connection element 121, a first adaptor board 122 and a plurality of metal pins 123 (e.g., copper pins or other metal pins). The first adaptor board 122 is disposed at one end of the first connection element 121 and connected to the other end of the first light source board 112. The metal pins 123 penetrate through the first adaptor board 122 and protrude from the other end of the first connection element 121. In this way, the first adaptor assembly 12 can serve as a male connector.

The second lamp tube assembly 13 includes a second lamp head 131, a second light source board 132 and a second tube body 133. The second light source board 132 is disposed in the second tube body 133 and one end of the second light source board 132 is connected to the second lamp head 131. The second light source board 132 may be a circuit board having a plurality of light-emitting elements disposed thereon. In this embodiment, the second light source 132 includes a second circuit board B2 and a plurality of light-emitting diodes LD disposed on the second circuit board B2. In one embodiment, the second circuit board B2 may be a flexible printed circuit board or other similar components. Similarly, the second lamp head 131 may have a second driving circuit disposed therein.

The second adaptor assembly 14 includes a second connection element 141, a second adaptor board 142 and a plurality of metal sleeves 143 (e.g., copper pins or other metal pins). The second adaptor board 142 is disposed at one end of the second connection element 141 and connected to the other end of the second light source board 132. The metal sleeves 143 penetrate through the second adaptor board 142 and the second connection element 141. In this way, the second adaptor assembly 14 can serve as a female connector.

Figure 4:
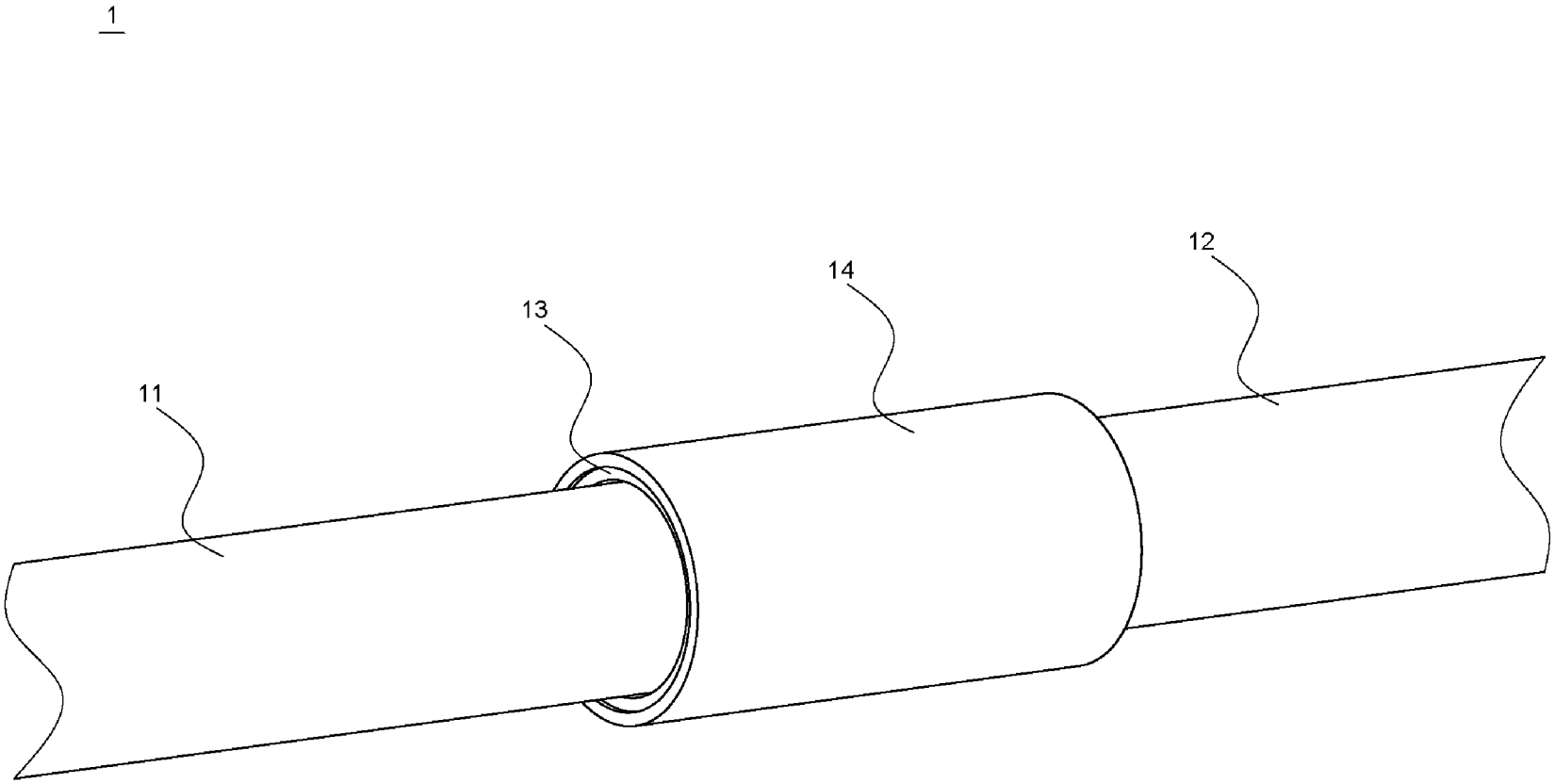
FIG. 4 is an assembly view of the spliced lamp tube in accordance with one embodiment of the present invention.

Please refer to FIG. 4, which is an assembly view of the spliced lamp tube in accordance with one embodiment of the present invention. As shown in FIG. 4, the spliced lamp tube 1 has a special mechanical connection structure. In other words, when the first adaptor assembly 12 is connected to the second adaptor assembly 14, the metal pins 123 can be inserted in to the metal sleeves 143, such that the first lamp head 111, the first light source board 112, the second lamp head 131 and the second light source board 132 can be electrically connected to each other. In addition, the inside diameter of the second connection element 141 is slightly greater than the outside diameter of the first connection element 121. Accordingly, when the first adaptor assembly 12 and the second adaptor assembly 14 are connected to each other, the second connection element 141 can be sleeved on and fixed with the first connection element 121. Via the aforementioned mechanical connection structure, the first lamp tube assembly 11 and the second lamp tube assembly 13 can be electrically connected to each other. In addition, the first lamp tube assembly 11 and the second lamp tube assembly 13 can be more stably fixed with each other and cannot be easily detached from each other. Therefore, the spliced lamp tube 1 can achieve high practicality.

It is worthy to point out that currently available long lamp tubes are hard to be transported and stored because of the long lengths of these lamp tubes, which significantly increases the transportation and storage costs thereof. On the contrary, according to one embodiment of the present invention, the first lamp tube assembly and the second lamp tube assembly can be electrically connected to each other and fixed with each other via the first adaptor assembly and the second adaptor assembly. Thus, the first lamp tube assembly and the second lamp tube assembly can be spliced together to form a complete lamp tube, which facilitates the transportation and storage of the spliced lamp tube in order to dramatically reduce the transportation and storage costs thereof.

Besides, according to one embodiment of the present invention, the spliced lamp tube can be directly installed on the lamp holders so as to respectively connect the first lamp head of the first lamp tube assembly and the second lamp head of the second lamp tube assembly to the neutral wire and the live wire of the lamp holders. Since the metal pins of the first adaptor assembly of the spliced lamp tube can inserted into the metal sleeves of the second adaptor assembly thereof, so the metal pins and the metal sleeves can be electrically connected to each other and corresponding to the live wire, the earth wire and the neutral wire. Accordingly, the spliced lamp tube can operate normally after being installed on the lamp holders.

Further, according to one embodiment of the present invention, the spliced lamp tube has a special mechanical connection structure, which can make the first lamp tube assembly and the second lamp tube assembly be electrically connected to each other. Besides, the first lamp tube assembly and the second lamp tube assembly can be more stably fixed with each other and cannot be easily detached from each other. Therefore, the spliced lamp tube can achieve high practicality. As described above, the spliced lamp tube according to the embodiments of the present invention can effectively solve the problems of prior art.

Figure 5:
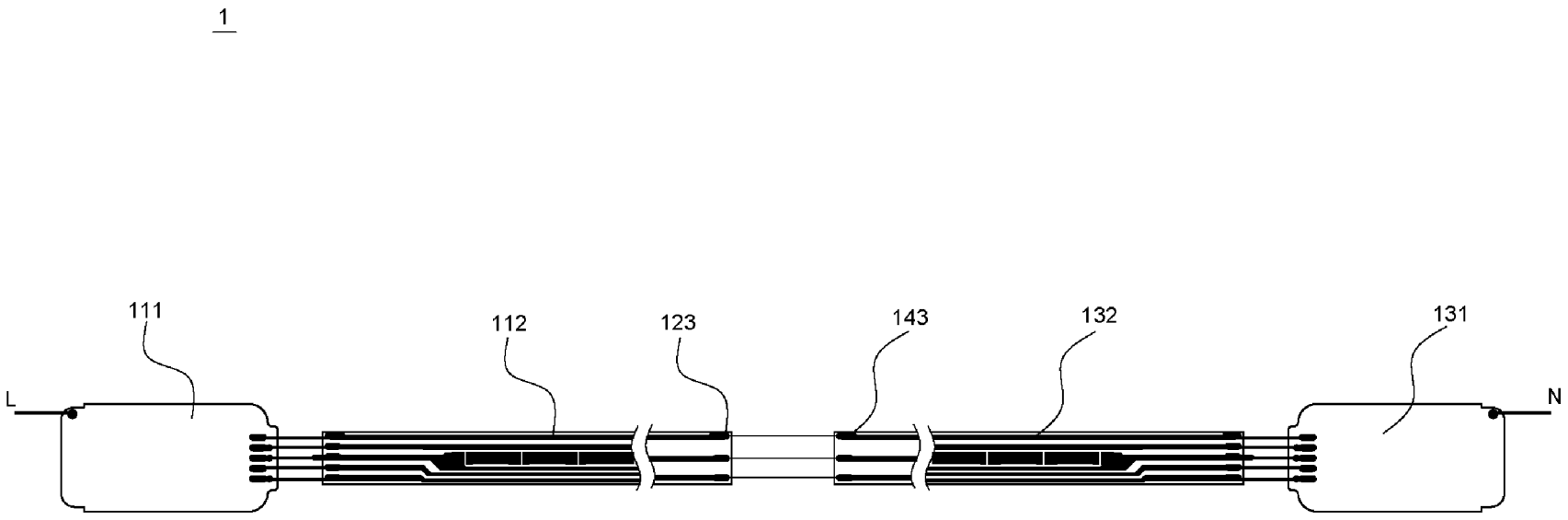
FIG. 5 is a view for illustrating an installation state of the spliced lamp tube in accordance with one embodiment of the present invention.

Please refer to FIG. 5, which is a view for illustrating an installation state of the spliced lamp tube in accordance with one embodiment of the present invention. As shown in FIG. 5, the metal pins 123 and the metal sleeves 143 can be corresponding to the live wire (L), the earth wire (GND) and the neutral wire (N). Thus, the spliced lamp tube 1 can be directly installed on the lamp holders to connect the first lamp head 111 of the first lamp tube assembly 11 and the second lamp head 131 of the second lamp tube assembly 13 to the live wire L and the neutral wire N respectively. Afterward, the spliced lamp tube 1 can operate normally.

Moreover, the metal pins 123 and the metal sleeves 143 can be further corresponding to a dimming circuitry and a power adjustment circuitry. Thus, the spliced lamp tube 1 can also provide dimming function, power adjustment function or other relevant functions. In this way, the spliced lamp tube 1 can provide more functions and the applications thereof can be more comprehensively.

Figure 6B:
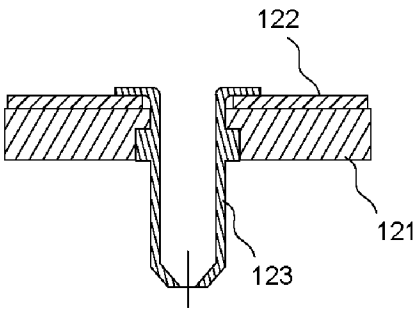
FIG. 6B is a sectional view of the first adaptor assembly of the spliced lamp tube in accordance with one embodiment of the present invention.
Figure 6A:
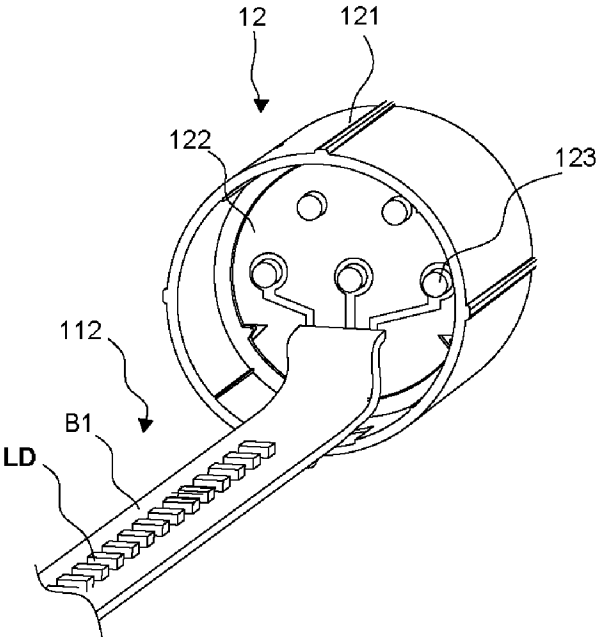
FIG. 6A is a view for illustrating a connection structure of a first light source board and the first adaptor assembly of the spliced lamp tube in accordance with one embodiment of the present invention.

Please refer to FIG. 6A and FIG. 6B. FIG. 6A is a view for illustrating a connection structure of a first light source board and the first adaptor assembly of the spliced lamp tube in accordance with one embodiment of the present invention. FIG. 6B is a sectional view of the first adaptor assembly of the spliced lamp tube in accordance with one embodiment of the present invention. FIG. 6A and FIG. 6B illustrate one of the possible connection structures of the first light source board 112 and the first adaptor assembly 12 of the spliced lamp tube 1. As shown in these figures, the first adaptor board 122 has a first groove G1 and the first light source board 112 has a bending portion corresponding to the first groove G1. The bending portion can be inserted in to the first groove G1 to connect the first light source board 112 to the first adaptor board 122, such that the first light source board 112 can be electrically connected to the metal pins 123. The metal pins 123 penetrate through the first adaptor board 122 and protrude from the other end of the first connection element 121.

Figure 7B:
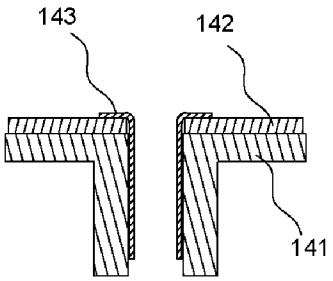
FIG. 7B is a sectional view of the second adaptor assembly of the spliced lamp tube in accordance with one embodiment of the present invention.
Figure 7A:
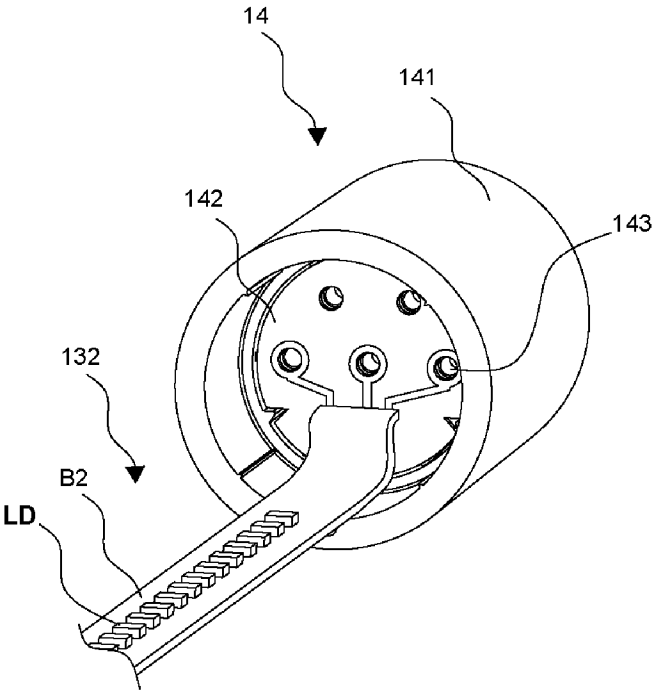
FIG. 7A is a view for illustrating a connection structure of a second light source board and the second adaptor assembly of the spliced lamp tube in accordance with one embodiment of the present invention.

Please refer to FIG. 7A and FIG. 7B. FIG. 7A is a view for illustrating a connection structure of a second light source board and the second adaptor assembly of the spliced lamp tube in accordance with one embodiment of the present invention. FIG. 7B is a sectional view of the second adaptor assembly of the spliced lamp tube in accordance with one embodiment of the present invention. FIG. 7A and FIG. 7B illustrate one of the possible connection structures of the second light source board 132 and the second adaptor assembly 14 of the spliced lamp tube 1. As shown in these figures, the second adaptor board 142 has a second groove G2 and the second light source board 132 has a bending portion corresponding to the second groove G2. The bending portion can be inserted in to the second groove G2 to connect the second light source board 132 to the second adaptor board 142, such that the second light source board 132 can be electrically connected to the metal sleeves 143. The metal sleeves 143 penetrate through the second adaptor board 142 and the second connection element 141.

The embodiment just exemplifies the present invention and is not intended to limit the scope of the present invention; any equivalent modification and variation according to the spirit of the present invention is to be also included within the scope of the following claims and their equivalents.

To sum up, according to one embodiment of the present invention, the first lamp tube assembly and the second lamp tube assembly can be electrically connected to each other and fixed with each other via the first adaptor assembly and the second adaptor assembly. Thus, the first lamp tube assembly and the second lamp tube assembly can be spliced together to form a complete lamp tube, which facilitates the transportation and storage of the spliced lamp tube in order to dramatically reduce the transportation and storage costs thereof.

Besides, according to one embodiment of the present invention, the spliced lamp tube can be directly installed on the lamp holders so as to respectively connect the first lamp head of the first lamp tube assembly and the second lamp head of the second lamp tube assembly to the neutral wire and the live wire of the lamp holders. Since the metal pins of the first adaptor assembly of the spliced lamp tube can inserted into the metal sleeves of the second adaptor assembly thereof, so the metal pins and the metal sleeves can be electrically connected to each other and corresponding to the live wire, the earth wire and the neutral wire. Accordingly, the spliced lamp tube can operate normally after being installed on the lamp holders.

Moreover, according to one embodiment of the present invention, the spliced lamp tube has a special mechanical connection structure, which can make the first lamp tube assembly and the second lamp tube assembly be electrically connected to each other. Besides, the first lamp tube assembly and the second lamp tube assembly can be more stably fixed with each other and cannot be easily detached from each other. Therefore, the spliced lamp tube can achieve high practicality.

Furthermore, according to one embodiment of the present invention, the metal pins of the first adaptor assembly and the metal sleeves of the second adaptor assembly of the spliced lamp tube can be corresponding to a dimming circuitry and a power adjustment circuitry. Thus, the spliced lamp tube can provide dimming function and power adjustment function, so can be more comprehensively in application.

It will be apparent to those skilled in the art that various modifications and variations can be made to the disclosed embodiments. It is intended that the specification and examples be considered as exemplary only, with a true scope of the invention being indicated by the following claims and their equivalents.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A spliced lamp tube, comprising:

a first lamp tube assembly, comprising a first lamp head and a first light source board, wherein one end of the first light source board is connected to the first lamp head;

a first adaptor assembly, comprising a first connection element, a first adaptor board and a plurality of metal pins, wherein the first adaptor board is disposed at one end of the first connection element and connected to another end of the first light source board, and the metal pins penetrate through the first adaptor board and protrude from another end of the first connection element;

a second lamp tube assembly, comprising a second lamp head and a second light source board, wherein one end of the second light source board is connected to the second lamp head; and a second adaptor assembly, comprising a second connection element, a second adaptor board and a plurality of metal sleeves, wherein the second adaptor board is disposed at one end of the second connection element and connected to another end of the second light source board, and the metal sleeves penetrate through the second adaptor board and the second connection element;

wherein the first adaptor board has a first groove and the first light source board has a bending portion corresponding to the first groove, and the bending portion is inserted into the first groove, whereby the first light source board is connected to the first adaptor board.

2. The spliced lamp tube of claim 1, wherein the first lamp tube assembly further comprises a first tube body and the first light source board is disposed in the first tube body.

3. The spliced lamp tube of claim 1, wherein the second lamp tube assembly further comprises a second tube body and the second light source board is disposed in the second tube body.

4. The spliced lamp tube of claim 1, wherein the first lamp head comprises a first driving circuit and the second lamp head comprises a second driving circuit.

5. The spliced lamp tube of claim 1, wherein the first adaptor assembly is a male connector and the second adaptor assembly is a female connector.

6. The spliced lamp tube of claim 1, wherein the second adaptor board has a second groove and the second light source board has a bending portion corresponding to the second groove, and the bending portion is inserted into the second groove, whereby the second light source board is connected to the second light source board.

7. The spliced lamp tube of claim 1, wherein the metal pins and the metal sleeves correspond to at least a live wire, an earth wire and a neutral wire.

8. The spliced lamp tube of claim 7, wherein the metal pins and the metal sleeves further correspond to a dimming circuitry and a power adjustment circuitry.

9. The spliced lamp tube of claim 1, wherein the first light source board and the second light source board are circuit boards having a plurality of light-emitting elements disposed thereon.

* * * * *